US006339378B2

(12) United States Patent
Seidel

(10) Patent No.: US 6,339,378 B2
(45) Date of Patent: Jan. 15, 2002

(54) ANTI-THEFT TACK DEVICE

(75) Inventor: Stuart T. Seidel, Boca Raton, FL (US)

(73) Assignee: Unisensor Corporation, Boca Raton, FL (US)

( * ) Notice: Subject to any disclaimer, the term of this patent is extended or adjusted under 35 U.S.C. 154(b) by 0 days.

(21) Appl. No.: 09/813,590

(22) Filed: Mar. 21, 2001

Related U.S. Application Data

(63) Continuation-in-part of application No. 09/327,696, filed on Jun. 8, 1999, now abandoned.

(51) Int. Cl.[7] ..... G08B 13/14

(52) U.S. Cl. ..... 340/572.8; 340/572.3; 340/572.6; 340/572.1

(58) Field of Search ..... 340/572.3, 572.6, 340/572.8, 572.1, 572.5

(56) References Cited

U.S. PATENT DOCUMENTS 5,367,289 A * 11/1994 Baro et al. ..... 340/566
5,392,028 A * 2/1995 Pichl ..... 340/572.5
5,841,349 A * 11/1998 Holmgren ..... 340/572
5,841,350 A * 11/1998 Appalucci et al. ..... 340/572
5,859,586 A * 1/1999 Sasagawa et al. ..... 340/572

* cited by examiner

*Primary Examiner*—Benjamin C. Lee
*Assistant Examiner*—Sihong Huang
(74) *Attorney, Agent, or Firm*—Lott & Friedland, P.A.

(57) ABSTRACT

An anti theft tack device incorporating a detectable element which can be attached to the body component of an existing electronic article surveillance security tag to replace the tack-like connecting component of the security tag. The anti theft tack device includes a connecting element, a base element, a housing that encloses elements whose proximity is detectable by the in-store electronic equipment, a means to releaseably secure the device to the article to be protected, and a means to releaseably engage the device to the body component of an existing surveillance tag. Engagement of the present device to a surveillance tag provides the ability to upgrade an existing surveillance tag incorporating a first detection technology to a second type of detection technology.

6 Claims, 4 Drawing Sheets

A

B

A

B

ANTI-THEFT TACK DEVICE

CLAIM OF PRIORITY

This application is a continuation in part of U.S. patent application Ser. No. 09/327,696, filed on Jun. 8, 1999, abandoned the contents of which are incorporated herein by reference.

TECHNICAL FIELD

This invention relates generally to theft deterrent devices, and this invention specifically relates to an electronic anti-theft tack-like device for attachment to an electronic article surveillance tag.

BACKGROUND OF THE INVENTION

In retail sales, theft deterrent devices that are attached to articles of merchandize to be protected have become an important tool to combat retail theft, as preventing theft of clothing garments and other articles in the retail environment is particularly difficult. Electronic article surveillance ("EAS") has become commonly used to designate a variety of techniques employed to electronically detect the unauthorized removal of merchandise from a store.

Virtually all EAS systems have in common two essential components. One component is a security tag affixed to each piece of merchandise to be protected from unauthorized removal. The other component is some form of instore electronic equipment, which is capable of detecting the proximity of one of the special security tags. In a typical EAS system, the tag may be provided with an electrical circuit which is configured so as to be resonant at a particular radio frequency, and the detecting equipment may consist of a pair of antennae, one radiating electrical signals in a band of frequencies which includes said resonant frequency and the other tuned to receive the transmitted signals. These antennae are positioned on opposite sides of a check-out aisle or store exit. When merchandise with a security tag attached passes between the antennas, the received signals are distorted by the tag's presence; electronic signal processing circuitry connected to the receiving antenna senses this distortion and triggers an alarm.

The typical security tag affixed to each article of merchandise usually consists of a tag body and a tack-like connecting component. The tag body includes a mechanical locking element which accepts a tack-like connecting component, and a housing that encloses the elements whose proximity is detectable by the in-store electronic equipment. The tack-like connecting component essentially consists of a pin element permanently attached to a base element. The pin element in the connecting component is designed to pierce or be inserted through an opening in the article of merchandise and then attach semipermanently to the tag body. In a typical arrangement, after application of the security tag, a portion of the article of merchandise is sandwiched between the tag body and the base element of the connecting component and can only be freed by store personnel using special equipment to unlock the locking mechanism in the tag body.

Examples of EAS security systems, including EAS security tags, are described in U.S. Pat. No. 5,367,289 to Baro et al. (the '289 patent); U.S. Pat. No. 5,859,586 to Sasagawa, et al. (the '586 patent); and U.S. Pat. No. 5,841,350 to Appalucci, et al. (the '350 patent).

The '289 patent describes a tag for use in an EAS system comprising a tag housing a flat bottom wall, a battery cavity, and a piezo bender cavity, and a retaining tack that protrudes perpendicularly from the flat bottom wall of the tag housing. A tack clip receives the retaining tack and comprises a locking mechanism for mechanically locking the tack clip to the retaining tack. Accordingly by placing the retaining tack through an article to be monitored, and locking the retaining tack in the tack clip, the tag is mechanically attached to the article.

The '586 patent describes an EAS capable of surely detecting magnetic fluxes emitted from transmission antennas irrespective of the position of a reception coil within a tag attached to goods.

The '350 patent describes a resonant tag circuit useful as an electronic security device that includes a layered planar structure having a dielectric substrate, a resonant circuit carried on both sides of the dielectric substrate and a semiconductive material having an ionizable salt dissolved therein.

Several EAS systems currently exist in the security industry. Each EAS security system and EAS security tag is unique, as each EAS system uses a particular detection technology such as acoustic magnetic technology developed by Sensormatic Electronics Corporation, swept-radio frequency technology ("RF systems"), and electro magnetic technology. All systems operate in conjunction with tags or labels attached to the article to be protected. Electronic or electric components concealed in the tag or label will respond with a more or less unique small signal when placed in proximity to EAS antenna(s) located usually at a particular interrogation or security zone.

Because each EAS system currently available uses only one of the foregoing technologies, department stores or other users of EAS systems usually use only one EAS system in conjunction with a particular EAS security tag which is intended for use with that particular detection technology. For example, an EAS user that uses an RF-based system, must use a security tag that is compatible with the RF system. The single-system limitation of currently available EAS security tags, however, has proven to be problematic and expensive to users who wish to keep up with developments and improvements to EAS technology.

The problem, briefly stated, is that manufacturers of EAS systems are continuously refining such systems with new or improved detection technologies developed in response to the discovery of weaknesses in existing systems. However, in order for an EAS user to take advantage of these new or improved systems, it must replace its entire EAS system, including both the in-store electronic detection equipment and the security tags. Although the replacement of the in-store detection equipment can be expensive, depending on the level of sophistication of the technology and the ease of installation, such a task only entails the replacement of relatively few pieces of equipment throughout a store. On the other hand, replacement of the security tags can prove a monumental task in both expense and wasted manpower for a typical department store which typically maintains hundreds of thousands of security tags per location.

A further problem that arises from single-system EAS security tags is that the tags may be limited to use at a single location. To illustrate the problem, consider a department store chain with multiple geographic locations that employs two different types of EAS systems installed throughout its stores. In order to make the two systems work properly, the department store chain will have to maintain in its inventory two types of security tags and will have to monitor quantities of each tag available on-hand so that replacement tags can be ordered before the inventory runs out. In addition to the relative unwieldiness of managing an inventory of multiple types of security tags, the department store chain will not be able to take full advantage of its purchasing power because, instead of being able to purchase a very large amount of tags of one type, it will have to purchase smaller amounts of tags of two types. This problem becomes more severe as the number of EAS technologies employed by the department store chain increases from two to three, and so on.

A single-system EAS security tag also does not allow a user as much flexibility in implementing two or more detection technologies within a single retail location. For instance, it may be desirable for a retailer to establish overlapping security zones for a particular department within a store. Such an arrangement could, for added security, employ two different detection methods, one for the particular department and one for the store as a whole. Such a system would emit an alarm upon the unauthorized removal of an item of merchandize from the department and a second alarm upon unauthorized removal of the item from the store. A retailer wishing to implement such a scheme using existing EAS technology would have to install two separate security tags on the item of merchandize. A security tag which could operate on dual detection systems would tremendously simplify the implementation of this type of scheme.

None of the devices disclosed in the prior art incorporate an anti theft security tag or device that can be easily upgraded without the need of replacing the entire inventory of security tags and compatible tag removal equipment.

In addition, none of the devices disclosed in the prior art describe an anti-theft security tag or device that can operate with two EAS systems with distinct detection technologies.

Therefore, there is a need in the prior art to provide an EAS anti-theft device that an EAS user can use to transition from a previous EAS system to a new EAS system without requiring the replacement of a user's entire inventory of security tags and compatible tag removal equipment.

There is a further need in the art to provide a EAS anti-theft device that allows a user to implement detection technologies for use with two EAS systems with distinct detection technologies using a single security tag.

There is a further need in the art to provide an EAS user with a device that permits the option of using dual detection technologies on a single security tag for customized security measures within a particular area of use.

SUMMARY OF THE INVENTION

The subject invention resolves the above-described needs and problems by providing a tack device which incorporates detectable element and can be attached to the body component of an existing EAS security tag to replace the tack-like connecting component of the existing EAS security tag.

The invention is a tack device for detecting theft of articles comprising a connecting element, a base element comprising a housing that encloses elements whose proximity is detectable by the in-store electronic equipment, a means to releaseably secure the device to the article to be protected, and a means to releaseably engage the device to the body component of an existing surveillance tag, wherein the connecting element is affixed to the base element and projects out from said base element. The connecting element comprises an elongated pin and an abutment part. The base element comprises a housing where detectable components for various types of EAS technologies may be enclosed. The means to releaseably secure the device to the article to be protected comprises piercing the article with the elongated pin of the device or otherwise inserting the elongated pin of the device through an opening in the article which is smaller than the device's base element. The means to releaseably engage the device to the surveillance tag comprises interlocking the connecting element, that is the elongated pin and abutment part of the connecting element, to the surveillance tag. Engagement of the present device to a surveillance tag provides the ability to upgrade an existing surveillance tag incorporating a first detection technology to a second type of detection technology.

Accordingly, it is an object of the present invention to provide an EAS anti-theft device that an EAS user can use to transition from a previous EAS system to a new EAS system without requiring the replacement of a user's entire inventory of security tags and compatible tag removal equipment.

It is an additional object of the present invention to provide an anti theft device that provides an additional detection technology for integration into an EAS user's existing EAS system.

It is an additional object of the present invention to provide a EAS anti-theft device that allows a user to implement detection technologies for use with two EAS systems with distinct detection technologies using a single security tag.

It is an additional object of the present invention to provide an EAS user with a device that permits the option of using dual detection technologies on a single security tag for customized security measures within a particular area of use.

These and other objects, features, and advantages of the present invention may be more clearly understood and appreciated from a review of ensuing detailed description of the preferred and alternate embodiments and by reference to the accompanying drawings and claims.

DETAILED DESCRIPTION OF THE PREFERRED EMBODIMENTS

Figure 1:
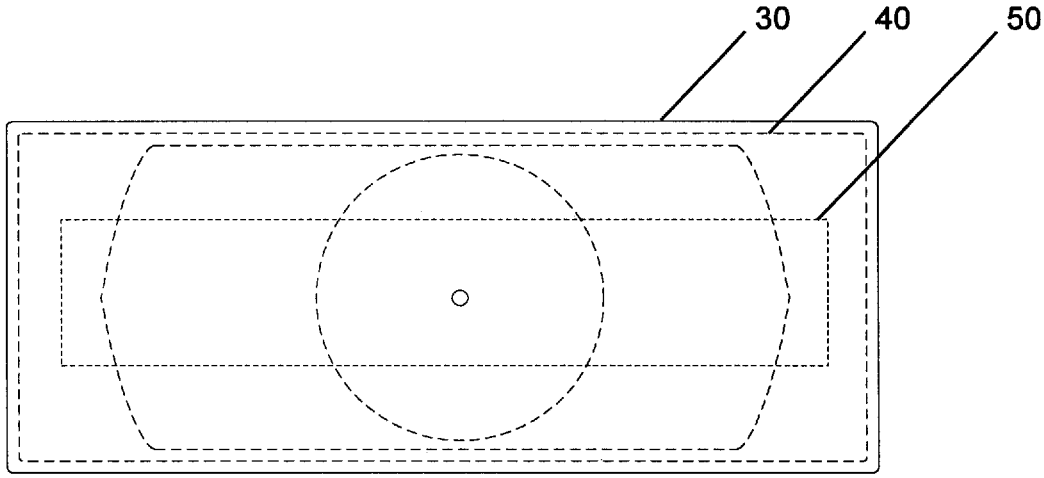
FIG. 1 shows top and side views of an embodiment of the present invention.
Figure 1:
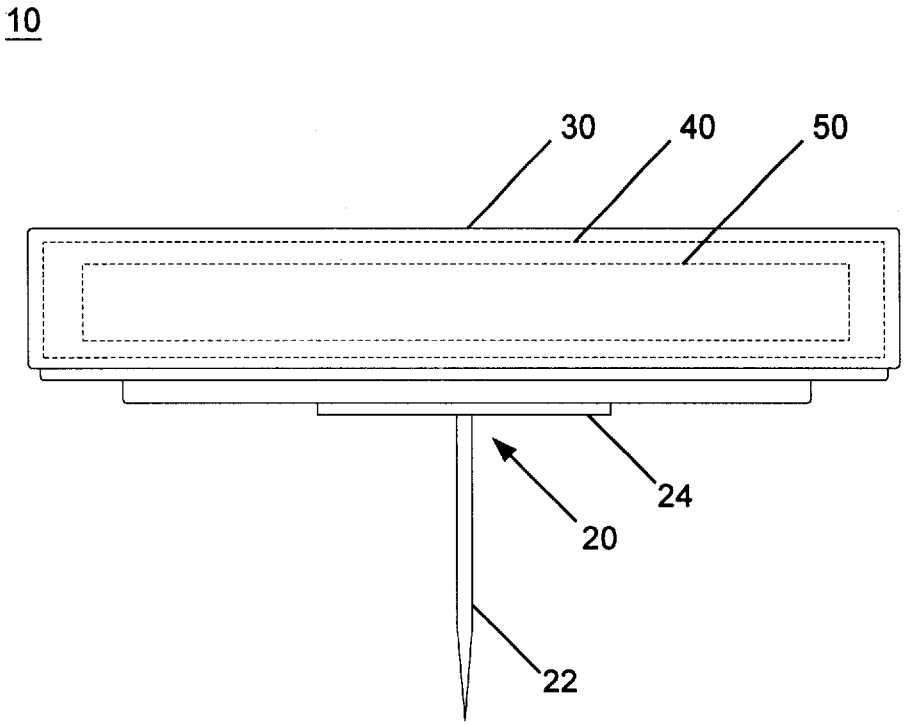

Referring initially to FIG. 1, the present invention relates to an EAS anti-theft tack device for detecting the theft of articles, designated generally as 10, comprising a connecting element 20, a base element 30 comprising a housing 40 enclosing elements 50 whose proximity is detectable by in-store electronic equipment, a means to releasebly secure the device to an article to be protected and a means to releaseably engage the device to an existing EAS surveillance tag. The connecting element 20 is permanently affixed to the base element 30 and projects out from one side of the base element 30. The connecting element 20 comprises an elongated pin 22 and an abutment part 24, shaped generally as a raised rectangular or circular area.

Figure 2:
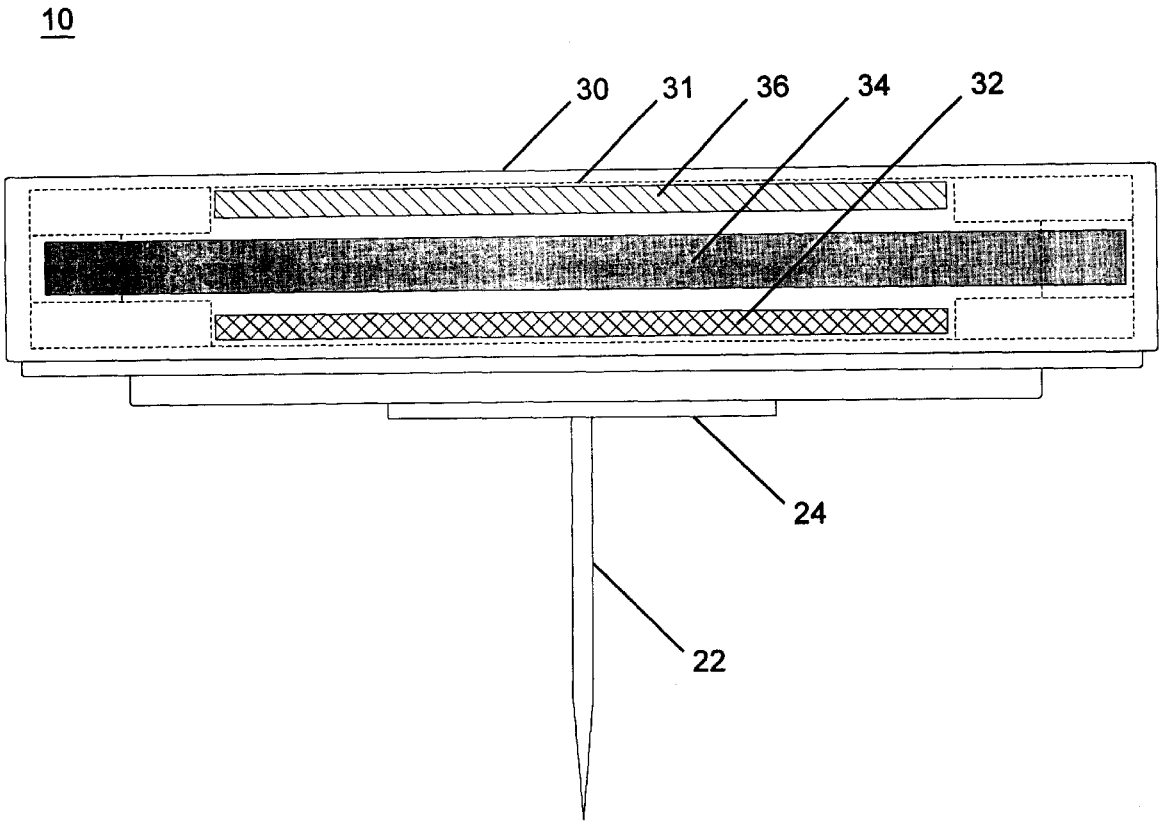
FIG. 2 shows a preferred embodiment of the present invention incorporating low frequency acoustic-magnetic detection technology.

In a preferred embodiment of the present invention, the detectable elements 50 enclosed by housing 31 incorporate low-frequency acoustic-magnetic detection technology. FIG. 2 illustrates this preferred embodiment. However, it should be understood that housing 31 can be adapted for use by any of a number of detection technologies and that the present invention is not limited to the use of low frequency acoustic-magnetic detection technologies. In FIG. 2, the base element 30 of the anti-theft device comprises a top plate 32, a separating plate 34, and a frequency transmitting plate 36. The top plate 32 comprises a magnetic plate or any other plate having magnetic characteristics, known in the art as a magnetic bias plate. Preferably the magnetic plate consists of thin plate of magnetized plastic. The top plate 32 serves to attract the electromagnetic waves of the frequency transmitting plate 36. As the top plate 32 serves to attract the frequency transmitting plate, the separating plate 34 serves to counter such attraction and keep the top plate 32 and frequency transmitting plate 36 apart. Thus, the separating plate 34 must be made of a plastic-like material that allows the top plate 32 to serve as an attraction force to the low-frequency transmitting plate 36. Generally, the separating plate 34 is of the following dimensions: 1.75 inches in length, 0.25 inches in width and 0.10 inches in height. The frequency transmitting plate 36 comprises a reception antenna adaptable to low frequency technology and capable of detecting a low magnetic flux for activation of the EAS system. Preferably, the reception antenna used in the present invention comprises an antenna strip generally about 0.50 by 1.50 inches and is capable of transmitting and receiving a low frequency and/or magnetic flux, such as an acoustic-magnetic frequency. Such low frequency is generally characterized between 1 Khz to 10 Mhz.

The base element 30 and abutment part 24 of the connecting element 20 are fabricated of a plastic-like material. Preferably, such material includes polystyrene.

The principles of operation of a low frequency acoustic-magnetic detection technology are well known in the art and are recited herein for completeness. As noted before, the present invention is not limited to use with low frequency acoustic-magnetic detection technologies but is adaptable to any type of technology by adjusting the size and shape of housing 31. Generally speaking, in an acoustic-magnetic detection system, the security tag is equipped with an embedded antenna component which is constructed to resonate when exposed to a signal of a particular frequency (i.e., the resonating signal). The frequency at which the antenna component resonates is determined by the size of the antenna component and the material from which it is constructed. Those skilled in the relevant art will recognize that the antenna for a low frequency acoustic-magnetic system may be fabricated in a number of ways to achieve resonance at varying frequencies. When the antenna component is exposed to its corresponding resonant signal it vibrates and in turn generates a signal of a different frequency (i.e. the response signal).

A feature of an acoustic-magnetic detection system is that in order for the antenna component to resonate when exposed to the resonant signal it must be exposed to a low level magnetic field. This is usually accomplished by placing a magnetic element near, but not in contact with, the antenna component. This feature permits the user to activate or deactivate a security tag by respectively magnetizing and de-magnetizing the magnetic element inside the tag.

In the preferred embodiment of the present invention illustrated in FIG. 2, the antenna element is represented by the frequency transmitting plate 36, the magnetic element is represented by top plate 32, the housing 31 is used to keep the antenna element in close proximity to the magnetic element, and the separating plate 34 is used as a mechanical barrier to keep the antenna element in from coming into contact with the magnetic element.

In operation, the user of a typical acoustic-magnetic detection system would purchase a security tag in deactivated state (i.e., with the magnetic element de-magnetized) and would activate it prior to attaching it to an article to be protected by exposing it to a magnetic field. At the periphery or exits of the security zone, the user would install the in-store detection equipment which consists of a transmitter tuned to transmit a resonating signal, a receiver equipped to detect a response signal and an alarm which is activated when a response signal is detected. When someone attempts to remove an article with an attached activated tag from the security zone, the antenna element in the tag is exposed to the resonating signal and in turn emits a response signal. The response signal is detected by the in-store receiver and the alarm is activated to alert store personnel of the removal attempt.

Figure 3:
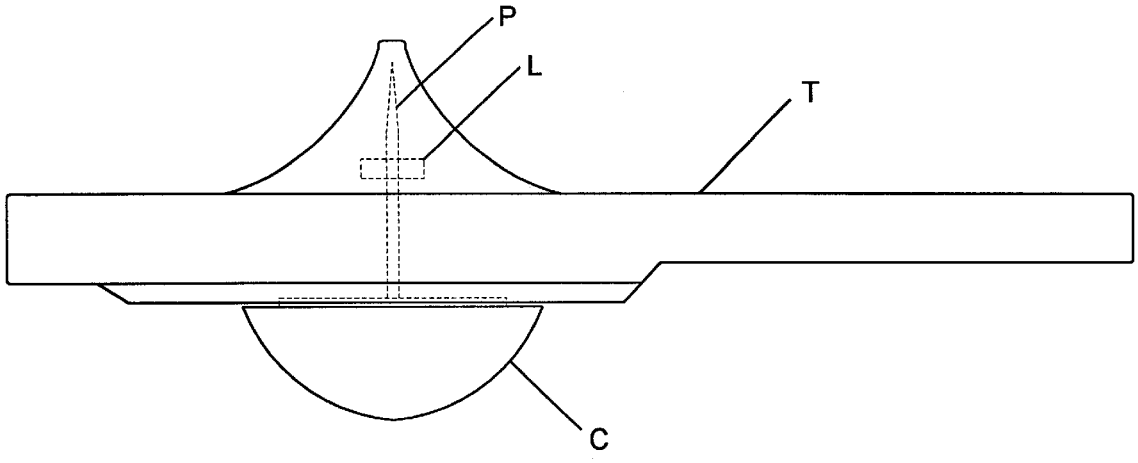
FIG. 3 shows side views of an existing security tag before (view "A") and after (view "B") replacement of the tack-like connecting component with an embodiment of the present invention
Figure 3:
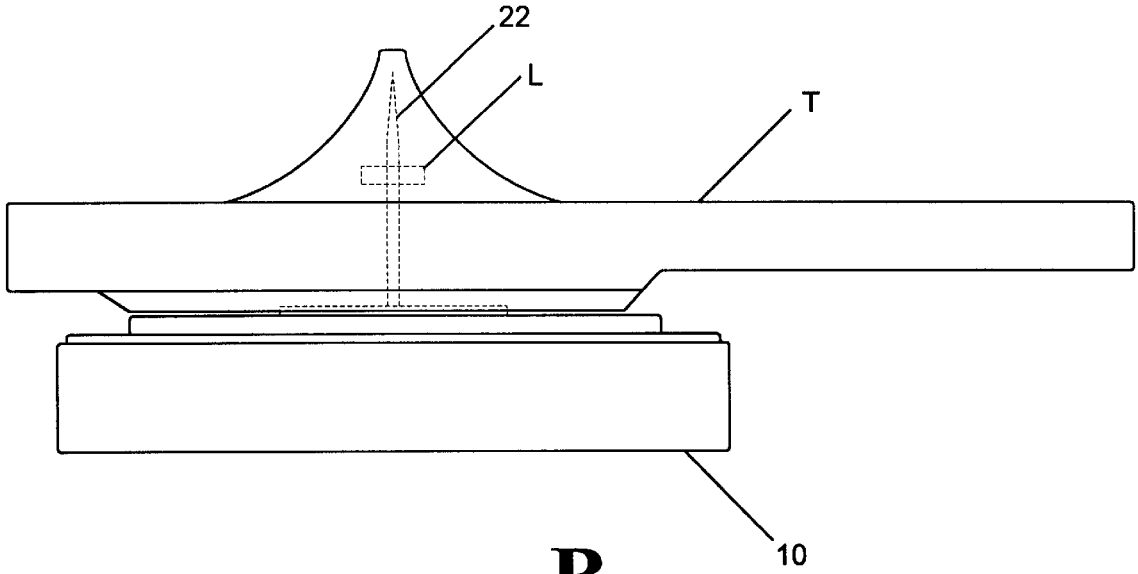

As shown in FIG. 3, view "A", prior to installation of the anti theft device of the present invention, an existing security tag is comprised of a tag body T and a tack-like connecting component C. The connecting component C is releaseably attached to the tag body T by means of an elongated pin P which is inserted through an orifice in the tag body T and is engaged by a locking mechanism L.

FIG. 3, view "B" shows the anti theft device of the present invention installed on the tag body T of the existing security tag. As illustrated, the anti-theft device of the present invention 10 replaces the connecting component C of the existing security tag and is releaseably attached to the tag body T in the same fashion as said connecting component. Namely, the elongated pin 22 is inserted through the orifice in tag body T and is engaged by the existing locking mechanism L.

Figure 4:
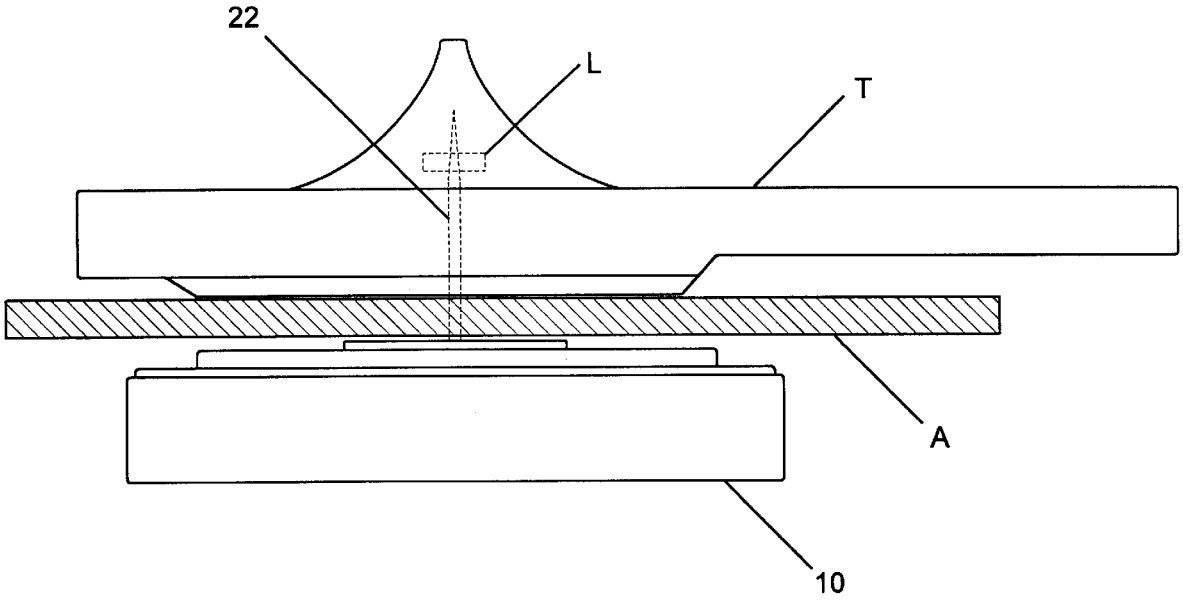
FIG. 4 shows a side view of an embodiment of the present invention installed on an existing security tag and attached to an article of merchandise to be protected.

FIG. 4 illustrates the anti theft device of the present invention secured to an article of merchandize A in conjunction with the existing security tag body T. The means to releaseably secure the device to article A, comprises piercing the article to be protected A with the elongated pin 22, thereby securing the device 10 to the article A. As the elongated pin 22 is generally shaped with a piecing edge, the device 10 is easily and releaseably attachable to the article to be protected A. Articles to be protected usually comprise clothing and or other garments made of pierceable material. Alternatively, elongated bin 22 may simply be inserted through an existing opening in article A where such opening is smaller than base element 30. The means to releasable engage the device 10 to the existing security tag body T comprises insertion of the elongated pin 22 into the existing orifice in tag body T and engaging elongated pin 22 with the locking mechanism L inside the tag body T. The connecting element 20 of the present invention may by modified to fit the a variety of existing tag bodies and locking mechanisms whose characteristics are well known to those skilled in the relevant art. For example as illustrated in FIG. 1, the abutment part 24 is generally circular in shape. However, such abutment part 24 can be generally rectangular in shape to fit a corresponding security tag T with a similarly shaped receiving surface.

Once the anti-theft tack-device 10 is connected into an existing security tag body T, the modified tag is compatible with an additional EAS system, namely, in the case of the illustrated preferred embodiment, one using a low-frequency detection technology. Therefore, a user of the present device is able to upgrade its existing EAS system for use with a low-frequency detection technology by installing the new EAS in-store electronic equipment system and purchasing the instant device 10, without the need to discard the "old" EAS tags. Additionally, an EAS user can use the present device to implement an additional EAS system based upon a low-frequency detection technology, allowing the use of two detection technologies at once. That is, if an EAS user wants to use a particular detection technology in one area, and implement a low-frequency detection technology in another area, the EAS user can do so without the need of using two distinct EAS tags.

Having described the invention in detail, those skilled in the art will appreciate that modifications may be made of the invention without departing from its spirit. Therefore, it is not intended that the scope of the invention be limited to the specific embodiment illustrated and described. Rather it is intended that the scope of the invention be determined by the appended claims and their equivalents.

What is claimed is:

1. A theft detection device for use with a tag body element of an existing EAS security tag comprising:

a connecting element;

a base element comprising a housing and a detectable element;

a means for releaseably securing said device to an article to be protected; and a means to releaseably engage said device to said tag body element of said existing EAS security tag, wherein said connecting element is affixed to said base element and projects out from said base element.

2. The device of claim 1, wherein said connecting element comprises an elongated pin.

3. The device of claim 2, wherein said detectable element is detectable by an acoustic-magnetic EAS system and comprises a plurality of plates including a top plate comprising a magnetic plate, a separating plate comprising a plastic plate, and a frequency transmitting plate comprising a low-frequency antenna.

4. The device of claim 3, wherein said means for releaseably securing said device to an article to be protected comprises piercing said article to be protected with said elongated pin, thereby securing said device to said article.

5. The device of claim 4, wherein said means to releaseably engage said device to said tag body element of said existing EAS security tag comprises inserting said elongated pin through an orifice in said tag body element of said existing EAS security tag and engaging an existing locking mechanism inside said tag body element of said existing EAS security tag.

6. A theft detection device for use with a tag body element of an existing EAS security tag comprising:

a connecting element having an elongated pin;

a base element comprising a housing and a detectable element, said detectable element being detectable by an acoustic-magnetic EAS system and comprised by a plurality of plates including a top plate comprising a magnetic plate, a separating plate comprising a plastic plate, and a frequency transmitting plate comprising a low-frequency antenna;

a means for releaseably securing said device to an article to be protected, wherein said means for releaseably securing said device to an article to be protected comprises piercing said article to be protected with said elongated pin, thereby securing said device to said article; and a means to releaseably engage said device to said tag body element of said existing EAS security tag, wherein said means to releaseably engage said device to said tag body element of said existing EAS security tag comprises inserting said elongated pin through an orifice in said tag body element of said existing EAS security tag and engaging an existing locking mechanism inside said tag body element of said existing EAS security tag.

* * * * *